US009163841B2

(12) United States Patent
Ramier et al.

(10) Patent No.: US 9,163,841 B2
(45) Date of Patent: Oct. 20, 2015

(54) CAST MANIFOLD FOR DRY LOW NOX GAS TURBINE ENGINE

(71) Applicant: SIEMENS ENERGY, INC., Orlando, FL (US)

(72) Inventors: Stephen A. Ramier, Fredericton (CA); Abhijeet Tiwary, Orlando, FL (US); Timothy A. Fox, Hamilton (CA); James Bertoncello, Charlotte, NC (US); Steven Williams, Charlotte, NC (US); Daniel W. Garan, Chuluota, FL (US)

(73) Assignee: SIEMENS AKTIENGESELLSCHAFT, München (DE)

( * ) Notice: Subject to any disclaimer, the term of this patent is extended or adjusted under 35 U.S.C. 154(b) by 600 days.

(21) Appl. No.: 13/622,510

(22) Filed: Sep. 19, 2012

(65) Prior Publication Data

US 2013/0074946 A1 Mar. 28, 2013

Related U.S. Application Data

(60) Provisional application No. 61/538,385, filed on Sep. 23, 2010.

(51) Int. Cl.
*F02C 7/228* (2006.01)
*F23R 3/36* (2006.01)
(Continued)

(52) U.S. Cl.
CPC . *F23R 3/36* (2013.01); *F23R 3/286* (2013.01); *F23R 3/346* (2013.01); *F23R 2900/00004* (2013.01); *F23R 2900/00005* (2013.01); *F23R 2900/00018* (2013.01); *Y10T 137/2931* (2015.04)

(58) Field of Classification Search
CPC ..... F23R 3/36; F23R 3/283; F23R 3/346; F23R 2900/00004; F23R 2900/00005; F23R 2900/00018
See application file for complete search history.

(56) References Cited

U.S. PATENT DOCUMENTS 3,288,355 A * 11/1966 Laing ..... 415/53.3
4,258,544 A * 3/1981 Gebhart et al. ..... 60/800
(Continued)

FOREIGN PATENT DOCUMENTS

EP 0375311 A1 6/1990
EP 0687865 A1 12/1995
EP 2182290 A1 5/2010

OTHER PUBLICATIONS

Alloy 20 webpage, http://en.wikipedia.org/wiki/Alloy_20, accessed on Jun. 8, 2015.*

*Primary Examiner* — Ehud Gartenberg
*Assistant Examiner* — Lorne Meade

(57) ABSTRACT

A casting (52) for a support housing (50), including: a fuel manifold (56) comprising an a-stage gas gallery (80) and a b-stage gas gallery (82); a-stage and a b-stage rocket bases (60) integrally cast with the fuel manifold (56), the a-stage gas gallery (80) in fluid communication with the a-stage stage rocket bases and the b-stage gas gallery (82) in fluid communication with the b-stage rocket bases; and one oil tube passageway (64) for each fuel rocket base (60), each oil tube passageway (64) spanning from an upstream end (66) of the fuel manifold (56) to an interior (68) of a respective fuel rocket base (60). Each oil tube passageway (64) is disposed radially inward of an inner perimeter (102) of the b-stage gas gallery (82).

17 Claims, 4 Drawing Sheets

(51) Int. Cl.
*F23R 3/28* (2006.01)
*F23R 3/34* (2006.01)

(56) References Cited

U.S. PATENT DOCUMENTS 4,609,150 A * 9/1986 Pane et al. ..... 239/397.5
4,930,703 A * 6/1990 Ford et al. ..... 239/424
4,938,418 A 7/1990 Halvorsen
5,058,703 A * 10/1991 Ealba et al. ..... 181/228
5,415,000 A * 5/1995 Mumford et al. ..... 60/747
6,672,073 B2 1/2004 Wiebe
7,926,279 B2 * 4/2011 Wasif et al. ..... 60/740
8,225,610 B2 7/2012 Reed et al.
8,479,520 B2 * 7/2013 Terada et al. ..... 60/742
8,544,276 B2 * 10/2013 Terada et al. ..... 60/746
2008/0072602 A1 * 3/2008 Wasif et al. ..... 60/740

* cited by examiner

CAST MANIFOLD FOR DRY LOW NOX GAS TURBINE ENGINE

This application claims benefit of the 23 Sep. 2011 filing date of application No. 61/538,385, which is incorporated by reference herein.

FIELD OF THE INVENTION

The invention relates to a dual fuel main burner nozzle used in a dry, low NOx gas turbine engine where a fuel manifold and rocket bases are integrally formed in a casting.

BACKGROUND OF THE INVENTION

Dry Low NOx (DLN) gas turbine engines include a can annular combustion arrangement where each can combustor includes a pilot burner and several main premix burners disposed circumferentially about the pilot burner. For each can combustor there is a main fuel nozzle that supplies one or more fuels to the main premix burners, and a pilot nozzle that supplies one or more fuels to the pilot burner. DLN engines produce 25 parts per million (PPM) NOx, or less. Ultra Low NOx (ULN) engines are an emerging class of engines that produce even lower levels of NOx than DLN engines.

DLN gas turbine engines are a result of an evolution of gas turbine engines where unwanted emissions have been reduced and efficiency increased by engine designs where the firing temperatures and operating pressures are ever increasing. The main burner fuel nozzle (a.k.a. support housing) is disposed in the compressed air manifold at an inlet end of the combustor where compressed air is at its greatest pressure, greatest temperature, and where the compressed air is undergoing a reversal of flow direction at the inlet end of the combustor. The high temperature and high pressure of the operating environment, as well as corrosive fuels, are known to cause stress corrosion cracking in the main fuel nozzle, which leads to limited life for the fuel manifold.

Concurrent with the need to survive in the relatively harsh DLN (as well as ultra low NOx (ULN) operating environment is a requirement that a fuel manifold of the main burner fuel nozzle be able to receive one or more fuel supplies and distribute them to several different fuel rockets, where there is one rocket for each premix main burner. The fuel rockets may further be divided into more than one stage. Further complicating the fuel manifold's design, in some embodiments the fuel manifold must be able to receive a second, different fuel and also distribute the second fuel to each rocket, also perhaps in more than one stage.

Conventionally, due to the complication of the fuel manifold, the required passages were machined into the fuel manifold. Milling, drilling, and welding-together the fuel manifold parts in order to create the complex channels resulted in stress risers where sharp corners were created, or where welds were located in regions of relatively high stress within the finished fuel manifold etc. In order to provide a fuel manifold that was strong enough to resist stress corrosion cracking long enough to provide a support housing with a viable lifespan, designers have used forged sub components and joined them together to form the fuel manifold. The fuel rockets were then welded to the forged fuel manifold. This technique has provided great flexibility in design, but it has a cost because the forged parts are more expensive, and machining it likewise expensive.

Complicating the matter still further is a need to provide for an expansion element on the main burner fuel nozzle to accommodate the relative thermal expansion of the internal fuel circuits. For example, in a dual fuel main burner nozzle, a fuel gas may be directed to an interior of the fuel rocket via one or more stages of fuel gas circuits. A fuel oil may also be directed through the fuel rocket and be ejected from the fuel rocket at a location proximate where the fuel gas is ejected. The fuel oil tube may be secured to the main burner nozzle and the fuel rocket ejection location, but the fuel rocket and the fuel oil tube often experience differential thermal expansion. Previously, this has been accommodated using a bellows type compensator built into the base of the fuel rocket. However, the thin plies of the bellows are highly susceptible to a number of failure modes, including stress corrosion cracking, cyclic failure, and rupture.

To overcome the foregoing problems and yet provide a main fuel nozzle having a reasonable service life designers have continued to seek stronger and stronger materials for the fuel manifold, and with this comes the attendant higher cost. Consequently, there remains room for improvement in the art.

BRIEF DESCRIPTION OF THE DRAWINGS

The invention is explained in the following description in view of the drawings that show.

DETAILED DESCRIPTION OF THE INVENTION

The present inventors have taken a comprehensive look at the design of the main fuel nozzles (a.k.a. support housing) and have developed a solution that reverses the conventional trend of seeking stronger materials for at least the fuel manifold portion of the support housing to ensure a reasonable service life for a DLN main fuel burner nozzle. Instead, the inventors have developed a DLN main burner support housing design that allows for the use of a substantially weaker casting for the fuel manifold portion, where the fuel manifold and rocket bases may be cast together. Using a casting is less expensive, and yet the new design is so effective it has been shown to improve the service life by as much as a factor of 2 over the previous forged designs.

Figure 1:
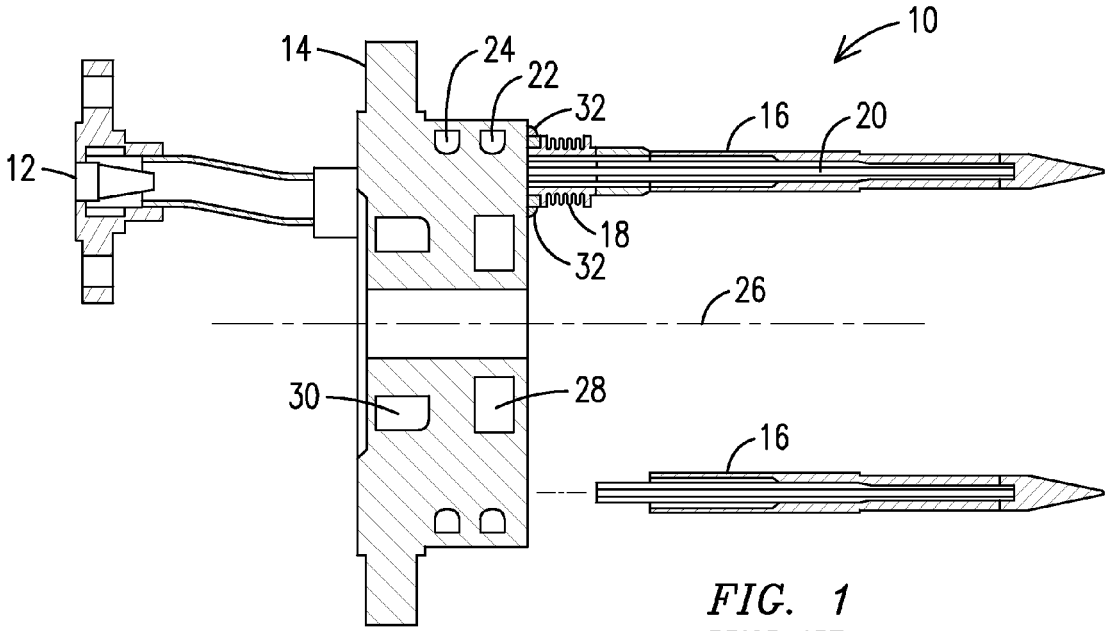
FIG. 1 PRIOR ART
FIG. 1 is a longitudinal cross section of a prior art dual fuel main burner nozzle.

FIG. 1 shows a longitudinal cross section of a prior art main burner nozzle 10, including a fuel gas inlet 12, a forged fuel manifold 14, and two of several fuel rockets 16. A bellows compensator 18 accommodates thermal growth between the fuel rocket 16 and an oil tube 20 disposed therein. Within the forged fuel manifold 14 there may be a first stage fuel oil gallery 22 and a second stage fuel oil gallery 24 for delivering fuel oil to each oil tube 20. Disposed radially inward with respect to a main burner nozzle longitudinal axis 26 there may be a first stage fuel gas gallery 28 and a second stage fuel gas gallery 30. The fuel rockets 16 are welded to the forged fuel manifold 14 via fuel rocket welds 32 at the base of the fuel rockets 16. The galleries of the forged fuel manifold 14 are conventionally formed by machining separate sub-parts of the forged fuel manifold 14, and welding them together to form the forged fuel manifold 14. The drilling, milling, and welding form sharp edges that may be difficult to access, and therefore some sharp corners are difficult to round. These sharp corners, and the welds from welding the sup-parts together, form stress risers. As a result the forged fuel manifold 14 is made of forged components in order to provide sufficient strength to yield a reasonable service life. Using a cast fuel manifold with the configuration of galleries depicted in FIG. 1 would produce a part unacceptable for use in a DLN engine, because the service life would be so short.

Figure 2:
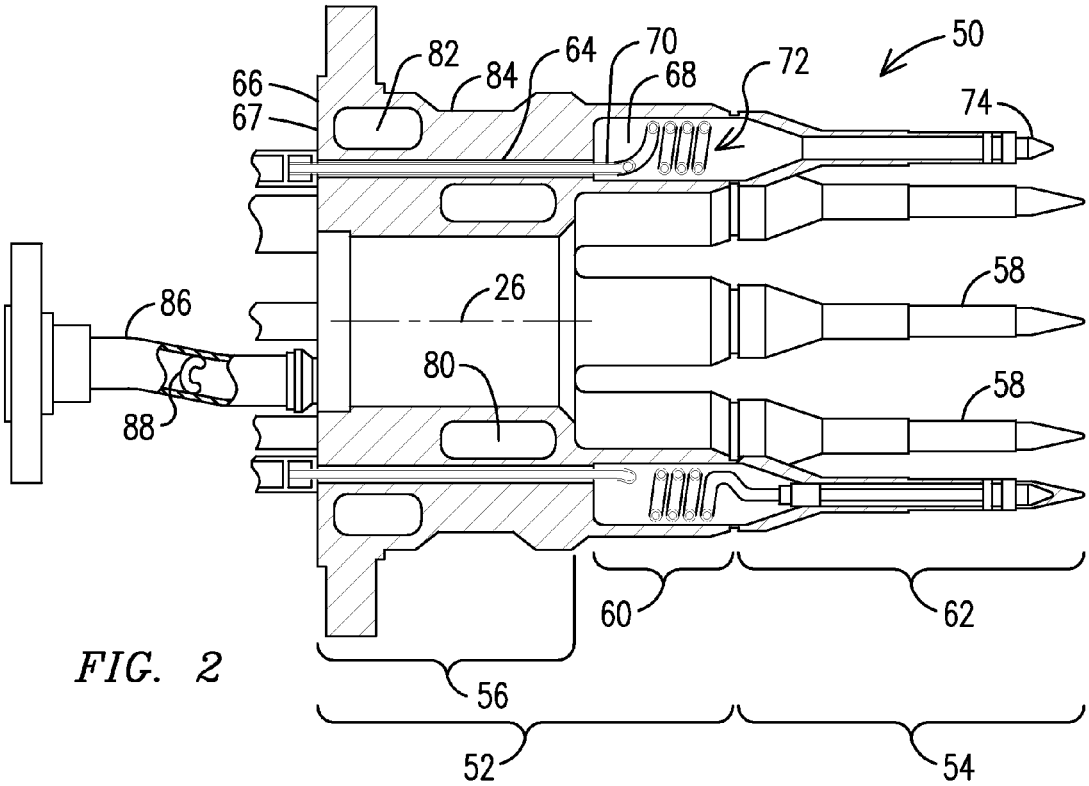
FIG. 2 is a longitudinal cross section of a dual fuel main burner nozzle/support housing.

FIG. 2 is a longitudinal cross section of the support housing 50 (a.k.a. main burner nozzle) disclosed herein, including a cast section 52 and a fuel rocket tip section 54. Similar to the prior art, the support housing 50 includes a fuel manifold 56 and a plurality of fuel rockets 58, but in this exemplary embodiment the fuel rockets 58 are made of a fuel rocket base 60 and a fuel rocket body 62 joined together. The fuel rocket bases 60 are, this exemplary embodiment, integrally cast with a fuel manifold 56 to form the cast section 52 of the present disclosure. This eliminates the fuel rocket welds 32 of the prior art, the associated stresses, and the shortened service life associated there with. The fuel rocket bases 60 may be welded to the fuel rocket body 62, but the weld will not be in a corner, but instead may be a more resilient butt weld, and therefore there will be less of a stress-concentrating effect, producing a much longer lasting support housing 50, despite the fuel manifold 56 and the fuel rocket bases 60 being made of a single cast section 52, which is weaker than the forgings traditionally used in a DLN engine.

Unlike the prior art, where there were fuel oil galleries within the fuel manifold to distribute the fuel oil, in the exemplary embodiment there are a plurality of oil tube passageways 64, each providing passage from an upstream end 66 of the fuel manifold 56, which is also an upstream end 67 of the cast section 52, to an interior 68 of a respective fuel rocket 58. Disposed within each oil tube passageway 64 may be a respective oil tube 70. Each oil tube 70 may include a thermal expansion element, such as a coil 72, which may be disposed in the respective fuel rocket base 60. Since the oil tube 70 is essentially fixed proximate the fuel manifold upstream end 66 and also fixed proximate a tip 74 of the fuel rocket 58, differential thermal expansion of the oil tube 70 with respect to the fuel rocket 58 necessitates the thermal expansion element (i.e. the coil 72) be present to provide relief. Due to limitations in the manufacturing of the oil tube 70 and in particular, a minimum diameter of the coil 72, the fuel rocket base 60 is made larger than prior art rocket bodies in order to accommodate the diameter of the coil 72.

Similar to the prior art, in the exemplary embodiment there may be an a-stage gas gallery 80 and a b-stage gas gallery 82 located relatively upstream of the a-stage gas gallery 80. In the prior art the fuel oil galleries 22, 24 are disposed relatively proximate an outer surface of the forged fuel manifold 14. This proximity to the warm compressed air flowing by the fuel manifold outer surface can, at times, raise the possibility of coking of the fuel oil in the fuel gas galleries. This, in turn, decreases service life of the main burner nozzle. Consequently, in the exemplary embodiment shown, the fuel oil galleries 22, 24 have been eliminated in favor of the oil tube passageways 64 and the oil tubes 70, which have also been moved radially inward with respect to the main burner nozzle longitudinal axis 26, away from a relatively warm outer surface 84 of the fuel manifold 56. In this manner not only is the fuel oil disposed at a greater distance from the warm compressed air than in the prior art designs, but as will be made clearer in following figures, most of the oil tube passageways 64 are disposed such that at least one, if not both stages of gas galleries completely surround material that defines the oil tube passageways 64. Thus, when fuel oil is being used, the fuel gas galleries and any fluid therein, such as compressed air etc, may act as a layer of insulation around most, if not all, of each of the oil tube passageways 64, thereby reducing even further any risk of coking.

Further, in the prior art design, having the fuel oil galleries 22, 24 disposed so close to the fuel manifold outer surface 84 resulted in a high thermal gradient in the region of the fuel manifold between the fuel oil galleries 22, 24 containing a supply of relatively cool fuel oil and the fuel manifold outer surface 84 that is exposed to the relatively warm compressor air. This large thermal gradient reduced the service life of the fuel manifold. In the configuration disclosed herein the oil tubes 70 have been moved radially inward and as a result there is a smaller thermal gradient in the area of the fuel manifold outer surface 84. These design changes work together to increase the service life of the support housing 50.

The design changes have also resulted in a decreased pressure drop experienced by fuel as it passes through the support housing 50. To provide control of the overall pressure drop between a fuel supply line 86 common to all the fuel rockets 58, a tuning orifice 88 may be installed. In addition to tuning the pressure drop, having a tuning orifice 88 in each combustor can enable better can-to-can tuning for optimum combustor system performance.

Figure 3:
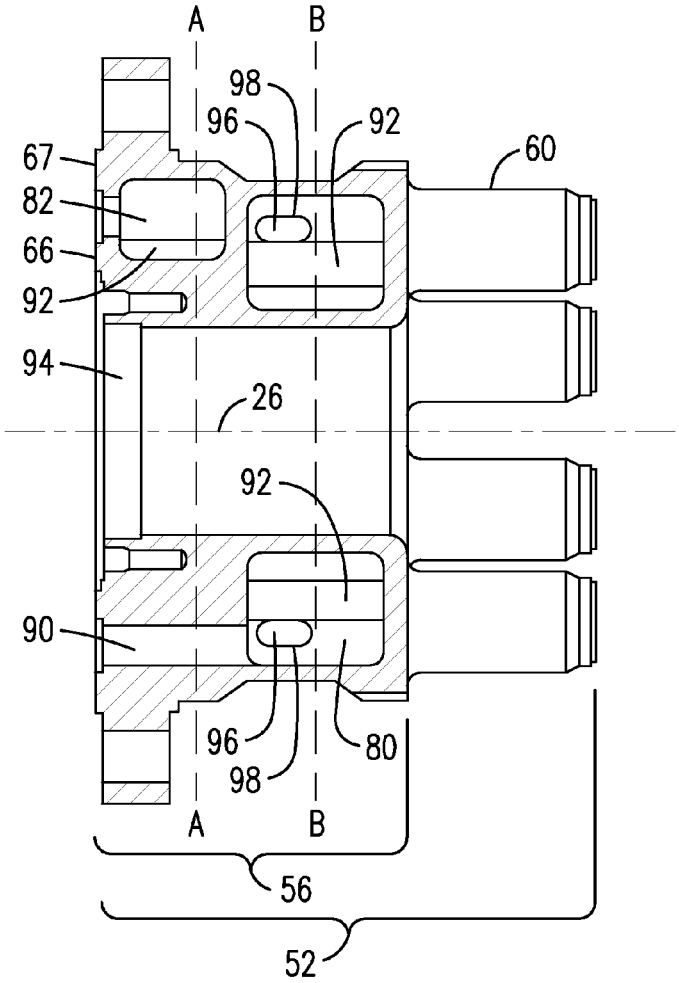
FIG. 3 is a longitudinal cross section of a cast section of the dual fuel main burner support housing of FIG. 2.

FIG. 3 is a longitudinal cross section of the cast section 52 of FIG. 2, with lines A-A and B-B through the fuel manifold 56 and along which cross sections are taken and described below. An a-stage gas feed 90 provides fluid communication between the fuel supply line 86 and the a-stage gas gallery 80. Material 92 that defines the oil tube passageways 64 is also visible in the a-stage gas gallery 80 and the b-stage gas gallery 82. A pilot burner nozzle opening 94 runs axially through the middle of the cast section 52. In the exemplary embodiment shown core print holes have been filled with core plugs 96 and core plug welds 98 secure the core plugs 96 in place. The core plug welds 98 are located so they are not within any corner of the a-stage gas gallery 80.

Figure 4:
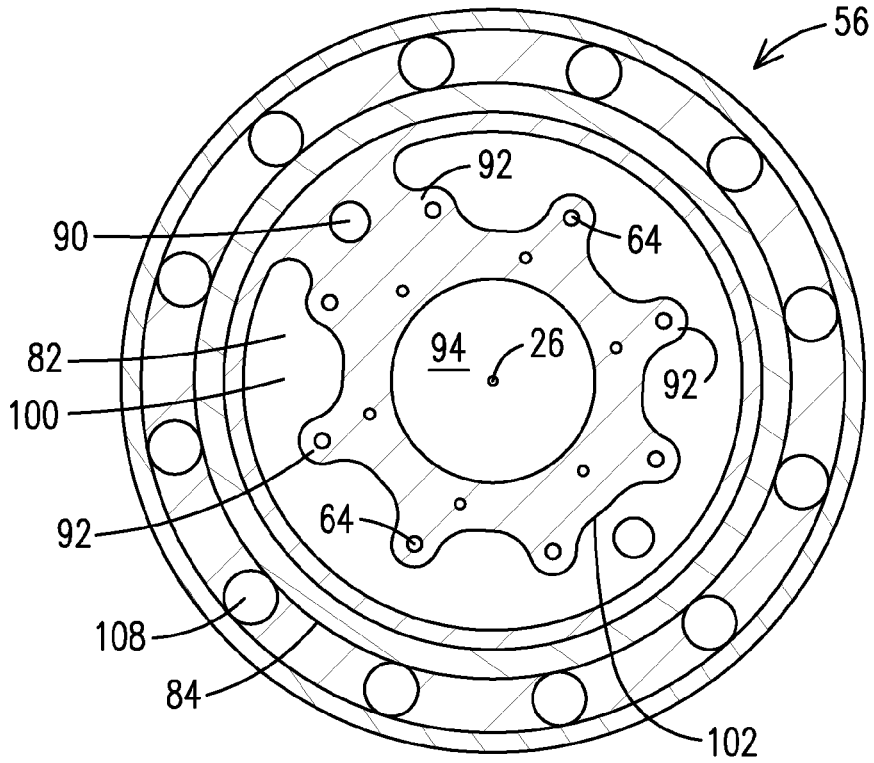
FIG. 4 is a cross section of a fuel manifold of the cast section of FIG. 3 along line A-A, looking upstream.

FIG. 4 is a cross section of the fuel manifold 56 of the cast section 52 of FIG. 3 taken along line A-A and looking upstream with respect to a flow of fuel gas within the case section 52. A b-stage perimeter surface 100 of the b-stage gas gallery 82 is visible, as well as the oil tube passageways 64 and the material 92 that defines the oil tube passageways 64. An inner perimeter 102 of the b-stage gas gallery 82 undulates circumferentially about the main burner nozzle longitudinal axis 26, and the oil tube passageways 64 are radially inward of the b-stage inner perimeter 102. As a result, in the exemplary embodiment shown, the b-stage gas gallery 82 provides a volume to insulate the oil tube passageways 64 from the fuel manifold outer surface 84 that contacts the warm and turbulent compressed air. The a-stage gas feed 90 is also disposed radially farther outward than the oil tube passageways 64, and thus may contribute to the insulating/cooling effect of the b-stage gas gallery 82. Also visible are bolt holes 108 used to secure the support housing 50 to a casing of the gas turbine engine. After considerations for the oil tube passageways 64, the a-stage gas feed 90, and the casting process etc., the b-stage gas gallery 82 can be envisioned as "fitting into" the space remaining.

Figure 5:
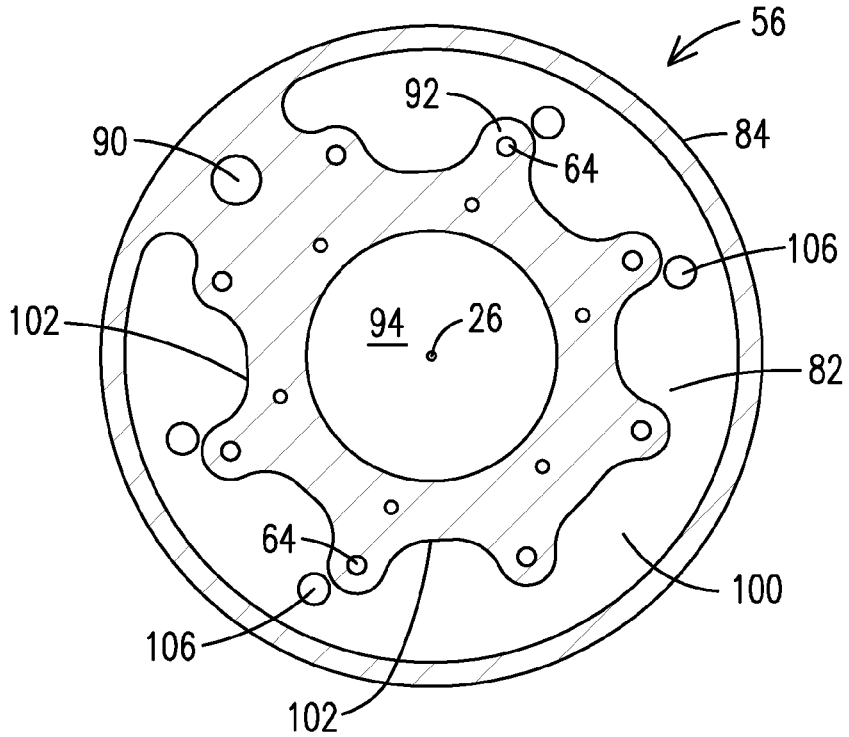
FIG. 5 is a cross section of a fuel manifold of the fuel manifold of FIG. 3 along line A-A, looking downstream.

FIG. 5 is a cross section of the fuel manifold 56 of the cast section 52 of FIG. 3 taken along line A-A and looking downstream. The b-stage inner perimeter 102 undulates in this view as well, and is disposed radially outward of the oil tube passageways 64. The a-stage gas feed 90 leads to the a-stage gas gallery 80, and the oil tube passageways 64 continue through the fuel manifold 56. Each b-stage rocket passage 106 provides fluid communication between the b-stage gas gallery 82 and a respective b-stage fuel rocket 58.

Figure 6:
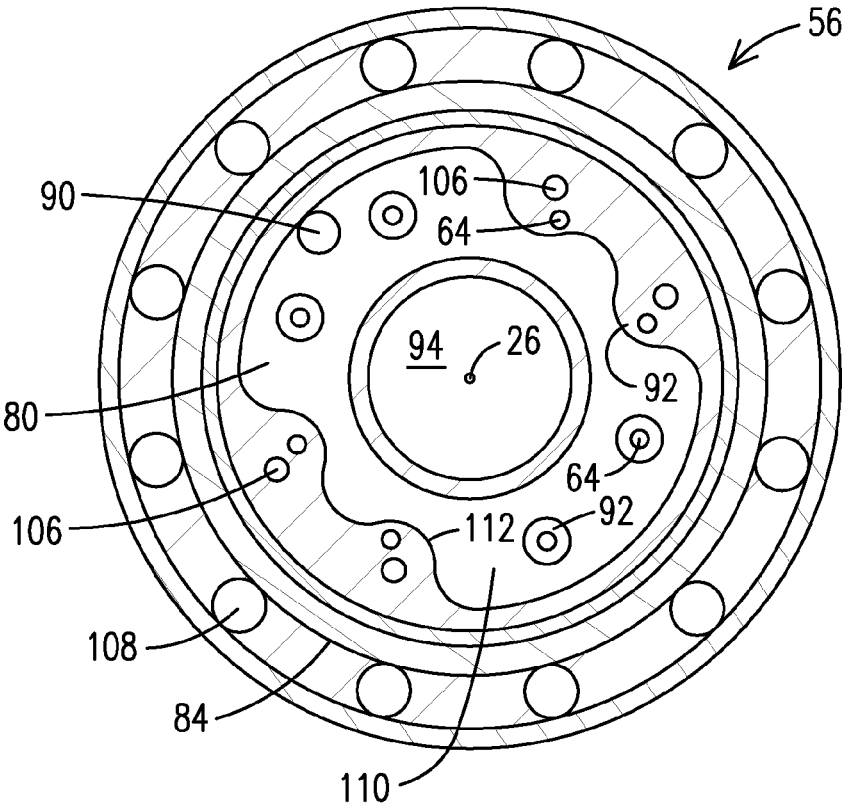
FIG. 6 is a cross section of a fuel manifold of the fuel manifold of FIG. 3 along line B-B, looking upstream.

FIG. 6 is a cross section of the fuel manifold 56 of the cast section 52 of FIG. 3 taken along line B-B and looking upstream. An a-stage perimeter surface 110 defines the a-stage gas gallery 80. An a-stage outer perimeter 112 (as opposed to inner perimeter) undulates circumferentially about the main burner nozzle longitudinal axis 26 to accommodate at least some of the oil tube passageways 64 and the material 92 that defines the oil tube passageways 64. The outer perimeter in some cases is radially outward of certain oil tube passageways 64, but radially inward of others. Thus, in this exemplary embodiment some of the oil tube passageways 64 and material 92 that defines the oil tube passageways 64 are not separated from the fuel manifold outer surface 84, and hence do not provide the same insulating effect. However, in those instances a b-stage rocket passage 106 can be disposed somewhat between an oil tube passageway 64 and the fuel manifold outer surface 84, which helps provide some insulating effect. The a-stage gas feed 90 opens to the a-stage gas gallery 80, providing a supply of fuel gas.

Figure 7:
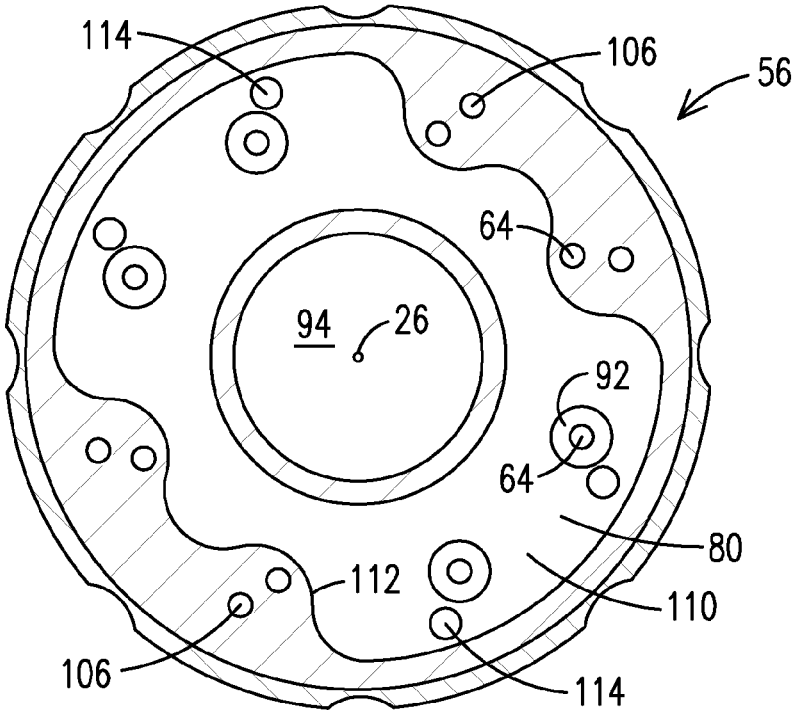
FIG. 7 is a cross section of a fuel manifold of the fuel manifold of FIG. 3 along line B-B, looking downstream.

FIG. 7 is a cross section of the fuel manifold 56 of the cast section 52 of FIG. 3 taken along line B-B and looking downstream. The a-stage outer perimeter undulates in this view as well, and is disposed radially outward of certain oil tube passageways 64, but radially inward of others. The b-stage rocket passages 106 continue through the fuel manifold 56 and open into the respective b-stage rocket base interior 68. Each a-stage rocket passage 114 provides fluid communication between the a-stage gas gallery 80 and a respective a-stage rocket base interior 68. The oil tube passageways also open to a respective fuel rocket interior 68. Thus, upon reaching an axial position downstream of the a-stage gas gallery 80, the fuel manifold 56 has distributed both fuels to respective rockets in stages as necessary, and has insulated the coking-sensitive fuel oil from the warm compressed air.

Figure 8:
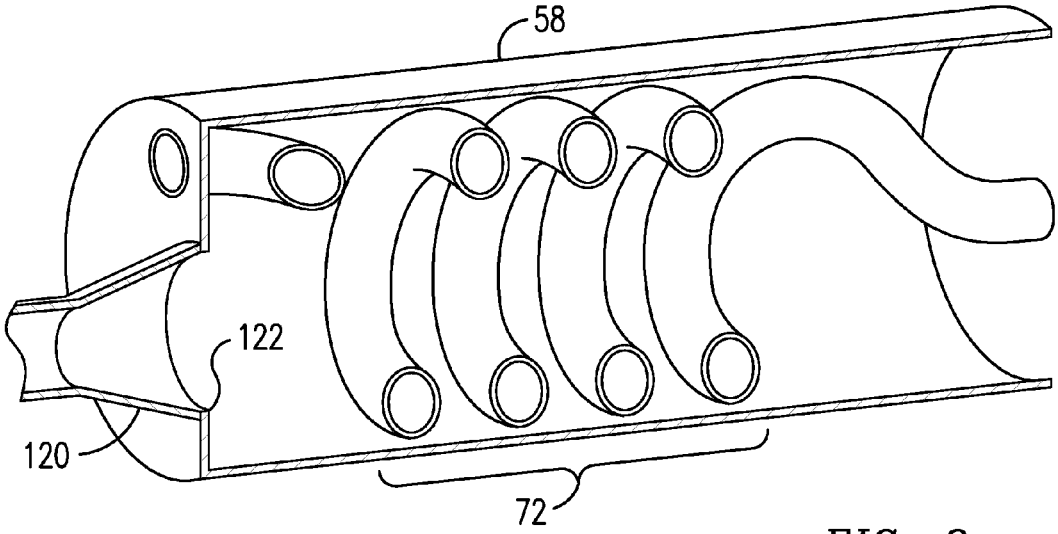
FIG. 8 is a cross section of a base of a fuel rocket and a fuel gas passageway with a diffuser.

FIG. 8 shows an exemplary embodiment of a diffuser 120 at a downstream end 122 of the oil tube passageway, or alternately when an oil tube is used, at a downstream end of the oil tube, within a fuel rocket 58. This diffuser slows a jet of fuel oil exiting the diffuser 120; thereby reducing the impact of flow induced vibration on the coil 72, as well as reducing the pressure drop within the support housing 50.

In light of the fact that the fuel manifold 56 and fuel rocket bases 60 are integrally cast, it is understood that the only welds that may be present in the cast section 52 may be present where core plugs 96 are used to fill core print holes in the cast section 52 formed by parts of a core used in manufacturing. These core plugs 96, and core plug welds 98 used to hold them in place, can readily be designed such that neither the core plug 96 nor core plug welds 98 are disposed in any corner within the cast section 52. Consequently, the cast section 52 may be almost entirely free of welds, and the minimal welds that do exist may be disposed remote from regions of relatively high stress. This further reduces the need to use a stronger forged material. Overall, the new design reduces stress in the fuel manifold 56 and fuel rocket bases 60 so much that the service life of the support housing 50 using the cast section 52 may be double that of the main burner nozzle 10 using the prior art, forged fuel manifold 14.

In particular, one property relating the strength of a material is the yield strength. For typical stainless steels and high nickel alloys that are used within fuel nozzles the cast version of these alloys has a yield strength that may be reduced by 30% from its forged counterpart. For example, at room temperature, forged IN625 has a yield strength of 410 Mpa, where cast IN625 has a yield strength of 300 Mpa. Other examples of acceptable materials for use in a DLN engine include but are not limited to: cast CN7M, which has a yield strength of 170 Mpa; forged HastX has a yield strength of 360 Mpa; forged Alloy20 has a yield strength of 240 Mpa; and forged 310 and 316 stainless steels both have yield strengths of 200 Mpa. Thus, materials having yield strengths below 200 Mpa may be used successfully in DLN engines and be created via the less expensive casting process.

Requirements for part life and operating condition will determine largely which alloy is needed to meet particular operating requirements. Typical operating conditions for a DLN gas turbine engine, which are considered relatively harsh, include an operating temperature for the fuel of 20-250 degrees Celsius, a shell temperature of 400-500 degrees Celsius, and operating pressures of 18-24 bar. Consequently, the cast support housing can be used so long as it provides at least the strength required to have a reasonable service life in the DLN engine, and can do so for less expenses than the forged support housing. The manifold disclosed herein may be suitable for use in a variety of DLN and ULN (ultra low emission) engines, including but not limited to Siemens models SGT6-5000F, SGT6-3000E, SGT5/6-8000H.

While various embodiments of the present invention have been shown and described herein, it will be obvious that such embodiments are provided by way of example only. Numerous variations, changes and substitutions may be made without departing from the invention herein. Accordingly, it is intended that the invention be limited only by the spirit and scope of the appended claims.

The invention claimed is:

1. A casting for a support housing, comprising:

a fuel manifold comprising an a-stage gas gallery and a b-stage gas gallery;

a-stage and b-stage rocket bases integrally cast with the fuel manifold, the a-stage gas gallery in fluid communication with the a-stage rocket bases but not with the b-stage rocket bases, and the b-stage gas gallery in fluid communication with the b-stage rocket bases but not with the a-stage rocket bases; and an oil tube passageway for each rocket base, each oil tube passageway spanning from an upstream end of the fuel manifold to an interior of a respective rocket base, wherein each oil tube passageway is disposed radially inward of an inner perimeter of the b-stage gas gallery, wherein at least one oil tube passageway is disposed between the inner perimeter of the b-stage gas gallery and an outer perimeter of the a-stage gas gallery, wherein said at least one oil tube passageway traverses through and is fully circumferentially surrounded by the a-stage gas gallery.

2. The casting of claim 1, wherein the b-stage gas gallery is disposed axially upstream of the a-stage gas gallery.

3. The casting of claim 2, wherein an inner perimeter of the a-stage gas gallery is disposed radially inward of the inner perimeter of the b-stage gas gallery.

4. The casting of claim 1, the oil tube passageway comprising a diffuser opening to the respective rocket base.

5. The casting of claim 1, further comprising discrete b-stage rocket passages, each one between the b-stage gas gallery and a respective b-stage rocket, wherein each b-stage rocket passage is disposed radially outward of the outer perimeter of the a-stage gas gallery.

6. The casting of claim 1, wherein the support housing further comprises:

a fuel supply line that supplies fuel to both the a-stage gas gallery and the b-stage gas gallery; and a tuning orifice disposed in the fuel supply line.

7. The casting of claim 1, wherein the support housing further comprises a thermal expansion element for each rocket base, each thermal expansion element disposed within a respective rocket base and in fluid communication with fluid traveling through the respective oil tube passageway.

8. The casting of claim 7, wherein the thermal expansion element com-prises a coil of an oil tube disposed within each rocket base.

9. A casting for a fuel nozzle for a DLN gas turbine combustor, comprising:

a fuel manifold comprising an a-stage gas gallery and a b-stage gas gallery;

a-stage rocket bases integrally cast with the fuel manifold and in fluid communication with the a-stage gallery but not the b-stage gallery, and b-stage rocket bases integrally cast with the fuel manifold and in fluid communication with the b-stage gallery but not the a-stage gallery, and at least one oil tube passageway through the fuel manifold, each opening into a respective rocket base;

wherein the casting is free of any welds other than those associated with a core plug in a core print hole, wherein said at least one oil tube passageway traverses through the fuel manifold and is fully circumferentially surrounded by at least one of the a-stage gas gallery and the b-stage gas gallery.

10. The casting of claim 9, wherein the b-stage gas gallery is disposed axially upstream of the a-stage gas gallery, and wherein all of the oil tube passageways are disposed radially within an inner perimeter of the b-stage gas gallery.

11. The casting of claim 10, wherein for a plurality of the oil tube passageways, material surrounding a respective oil tube passageway is completely surrounded by the b-stage gas gallery.

12. The casting of claim 10, wherein all gas passages are disposed radially farther out than all oil tube passageways.

13. The casting of claim 10, further comprising discrete b-stage rocket passages, each one between the b-stage gas gallery and a respective b-stage rocket.

14. The casting of claim 9, wherein the casting is part of a main fuel burner nozzle, and the main burner fuel nozzle further comprises a coil of an oil tube disposed in each rocket base, the oil tube in fluid communication with fuel oil passing through the oil tube passageway.

15. A casting for a fuel nozzle for a DLN gas turbine combustor, comprising:

a fuel manifold comprising an a-stage gas gallery and a b-stage gas gallery;

a plurality of rocket bases, comprising a-stage rocket bases in fluid communication with the a-stage gas gallery but not the b-stage gallery, and b-stage rocket bases in fluid communication with the b-stage gas gallery but not the a-stage gallery, wherein the fuel manifold and the plurality of rocket bases are integrally cast together;

wherein material forming the fuel manifold and the plurality of rocket bases comprises a yield strength below 200Mpa at room temperature, at least one oil tube passageway arranged to traverse through the fuel manifold and being fully circumferentially surrounded by at least one of the a-stage gas gallery and the b-stage gas gallery.

16. The casting of claim 15, wherein: the a-stage gas gallery is in fluid communication with the a-stage rocket bases via respective discrete a-stage rocket passages;

the b-stage gas gallery is in fluid communication with b-stage rocket bases via respective discrete b-stage rocket passages, and wherein the b-stage gas gallery is disposed axially upstream of the a-stage gas gallery;

the casting further comprising:

an a-stage gas feed passage providing fluid communication between an upstream end of the fuel manifold and the a-stage gas gallery, through the b-stage gas gallery, and a plurality of oil tube passages, each passing from the upstream end of the fuel manifold to a respective rocket base interior, wherein all of the rocket passages are disposed radially farther outward than all of the plurality of oil tube passages.

17. The casting of claim 16, wherein the casting is part of a main fuel burner nozzle, and the main burner fuel nozzle further comprises a coil of an oil tube disposed in each rocket base, the oil tube in fluid communication with fluid in the oil tube passageway.

* * * * *